United States Patent [19]

Seiler et al.

[11] 4,036,124

[45] July 19, 1977

[54] SLUDGE PRESS

[76] Inventors: Niklaus Seiler, Neuenhofstr. 20, 5600 Lenzburg; Hanspeter Seiler, Erzgrubenweg 18, 5000 Aarau, both of Switzerland

[21] Appl. No.: 558,717

[22] Filed: Mar. 14, 1975

[30] Foreign Application Priority Data

Mar. 18, 1974 Switzerland ..... 3701/74

[51] Int. Cl.[2] ..... B30B 15/08; B30B 1/32

[52] U.S. Cl. ..... 100/98 R; 100/185; 100/188 R; 100/209; 100/269 R; 110/109; 214/23

[58] Field of Search ..... 100/53, 39, 41, 209, 100/98 R, 269 R, 179, 185, 188; 214/23; 110/109

[56] References Cited

U.S. PATENT DOCUMENTS

| | | | |
|---|---|---|---|
| 3,513,768 | 5/1970 | Altmann | 100/98 R |
| 3,559,823 | 2/1971 | Ostrin | 214/23 |
| 3,604,345 | 9/1971 | Boje | 100/98 R |
| 3,802,337 | 4/1974 | St.-Hilaire | 100/98 R |
| 3,855,950 | 12/1974 | Hughes | 110/109 |

FOREIGN PATENT DOCUMENTS

| | | | |
|---|---|---|---|
| 150,690 | 2/1932 | Switzerland | 100/185 |

*Primary Examiner*—Billy J. Wilhite
*Attorney, Agent, or Firm*—Michael J. Striker

[57] ABSTRACT

A sludge press wherein a piston is reciprocable along a horizontal path between a retracted position in the interior of a hopper and an extended position in which the piston is located in and at the front end of a barrel extending forwardly from and communicating with the hopper so that the piston thereby expels a slug of compacted sludge through the open front end of the barrel. The front end of the barrel can be sealed by the knife-like valve member of a gate valve during movement of the piston to retracted position. The front end face of the piston is surrounded by a cutting edge which cooperates with a complementary annular cutting edge at the rear end of the barrel to sever solid ingredients of sludge during penetration of the piston into the barrel. The cutting edge of the valve member cooperates with a complementary cutting edge surrounding an opening in the rear section of the housing of the valve.

26 Claims, 9 Drawing Figures

13
12
14
41
40
11
39
8
5
3
3a
6
2
9
1a
55
42a
42
181
180
18
19
1
16a
16
27
28
1b
34
33
32
25
23
24
26
31
21
22a
22
36
37
29

II
13
12
14
11
14a
41
40
8
7
5
3
6
2
4
10
H
9
181
180
55
19
39
1
18
15
17
43
44
16
42
27
V
23
24
26
21
20
22
28
25

25''
25'
34a''
34a'
34''
34'
34a
34
33
52
48
53a
53
51a
45
79
78
77
76
75
74
80
73
14
13
13a
50
51
49a
47
49
46
42''
42'
13a''
13''
13a'
13'
70
69
68
67
58
57
66
65
62
61
72
72a
71
64a
64
63
60
59
82
83
81

SLUDGE PRESS

BACKGROUND OF THE INVENTION

The present invention relates to reciprocating presses in general, and more particularly to improvements in presses which can be used for compacting and controlled evacuation of sludge from a hopper or an analogous receptacle for solid, semisolid and/or liquid material.

Compacted waste (e.g., household or industrial garbage or partially processed sewage) is normally fed into a furnace wherein the waste material is combusted and/or evaporated. Such material often contains rocks, stones, particles of metal or glass and/or other solid ingredients which are surrounded by slush, such as sediments deposited during treatment of sewage. In accordance with the presently prevailing practice, waste material of the just described character is packed into sacks which are dumped into the furnace. It is also known to employ chain conveyors for transport of waste into an incinerator furnace or the like. The interior of the furnace is heated (either by oil or by gas) to a temperature at which at least some ingredients of the waste are combusted or evaporated. The just described methods of feeding waste to furnaces of incinerators are time-consuming and expensive. Moreover, the admission of discrete batches of waste often causes explosions in the interior of the furnace with resulting damage to or complete destruction of the incinerator plant.

SUMMARY OF THE INVENTION

An object of the invention is to provide a novel and improved press which can be used to convey waste into the furnace of an incinerator plant.

Another object of the invention is to provide a novel and improved reciprocating press which is especially suited for compacting and conveying slugs of waste material containing metallic, vitreous and/or other solid ingredients.

A further object of the invention is to provide a press which can be used to convey waste into an incinerator furnace in the form of a continuous or substantially continuous rod or stream to thereby reduce the likelihood of explosions in and attendant damage to or destruction of the furnace.

One feature of the invention resides in the provision of a press, particularly a sludge press, which comprises a receptacle for the material to be pressed (such receptacle may constitute a hopper or funnel which is open at the top), an elongated hollow barrel having an open rear end in communication with the interior of the receptacle and an open front end, a piston which is reciprocable in line with the barrel between a retracted position (in which the piston is preferably located in the interior of the receptacle and is remote from the rear end of the barrel) in which the material which has been admitted into the receptacle can enter the rear end of the barrel and an extended position in which the piston is located in and at least close to the front end of the barrel (in fact, the piston may extend forwardly beyond the barrel when it reaches the extended position), a front end face provided on the piston and surrounded by an annular cutting edge, a complementary annular cutting edge provided at the rear end of the barrel and cooperating with the first mentioned cutting edge to sever solid ingredients of material which tend to obstruct the penetration of the piston into the barrel, and a valve (e.g., a gate valve) provided at the front end of the barrel and having a valve member (e.g., a flat knife having at its lower end a transversely extending cutting edge) which is movable between a first position in which the front end of the barrel is at least substantially sealed, particularly during movement of the piston from the extended toward the retracted position, and a second position in which the front end of the barrel is exposed so that the piston can expel material from the barrel forwardly during movement to its extended position.

The press preferably further comprises first motor means (e.g., a hydraulic double-acting cylinder and piston unit) which is operable to move the piston between the extended and retracted positions, second motor means (e.g., a second hydraulic double-acting cylinder and piston unit) which is operable to move the valve member between the first and second positions, and control means (e.g., a group of valves which are connected between an oil pump or an analogous source of pressurized fluid and the cylinders of the units) for operating the motor means (either in response to manual adjustment of the valves or by resorting to a system which actuates the valves in a predetermined sequence).

The novel features which are considered as characteristic of the invention are set forth in particular in the appended claims. The improved press itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 2:
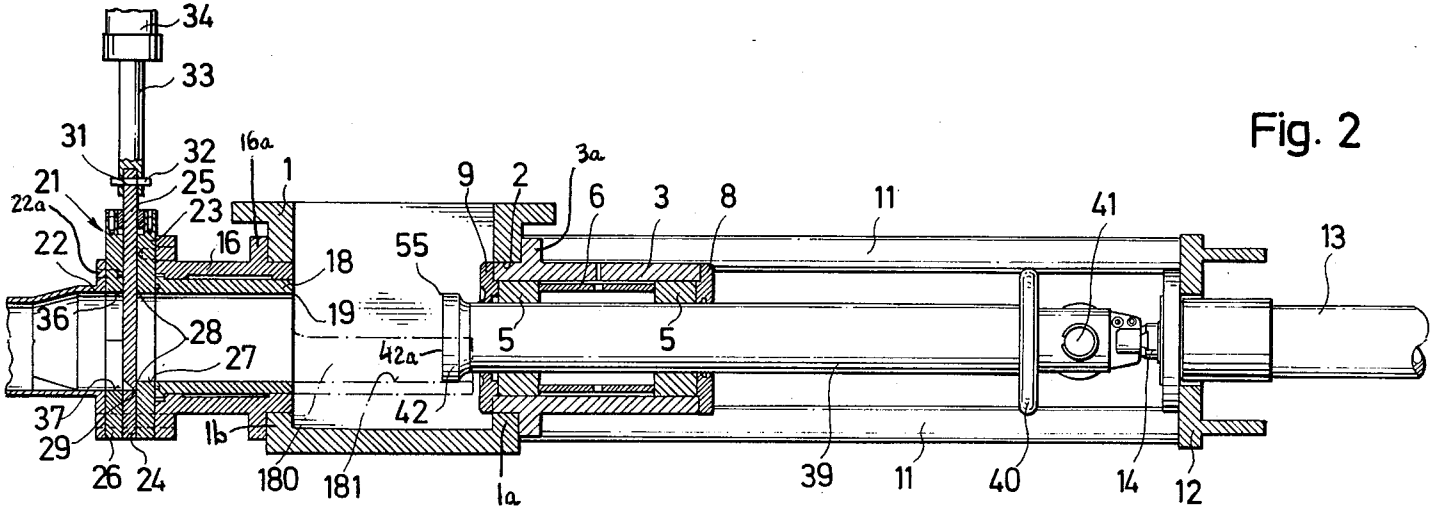
FIG. 2 is a sectional view as seen in the direction of arrows from the line II—II of FIG. 1.
Figure 1:
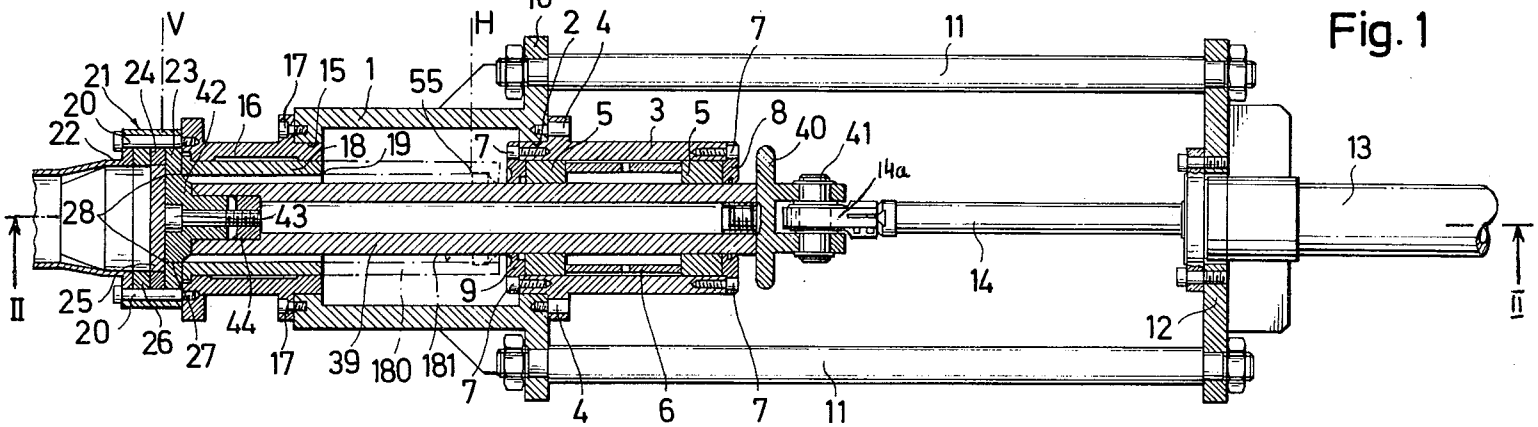
FIG. 1 is a central longitudinal horizontal sectional view of a sludge press with a single piston which embodies one form of the invention, the piston being shown in the extended position.

Referring first to FIGS. 1 and 2, there is shown a heavy-sludge press with a single piston 42 and without suction valves. The press comprises a receptacle or hopper 1 which is open at the top and the rear end wall 1*a* of which is formed with a circular opening 2 for the front end portion of a sleeve 3 having a flange 3*a* which is secured to the end wall 1*a* by bolts, screws or analogous fasteners 4. The material to be converted into a continuous or substantially continuous rod-like body or slug is fed by gravity or is forcibly introduced into the hopper 1 so that it at least partially fills the space between the front and rear end walls 1*a*, 1*b*. The material to be compacted and converted into a slug may contain solid, semisolid and/or liquid ingredients, for example, ingredients of the type constituting industrial garbage or partially processed sewage.

The sleeve 3 contains two annular friction bearings 5 for the hollow shank 39 of the piston 42. The two friction bearings 5 are held apart by a cylindrical distancing element 6 which is but need not be a tight fit in the median portion of the sleeve 3. The front end portion of the sleeve 3 is connected to a sealing ring 9 by means of screws or other suitable fasteners 7, so that the ring 9 sealingly engages the periphery of the shank 39 and simultaneously holds the front friction bearing 5 against axial movement toward the interior of the hopper 1. A similar sealing ring 8 is affixed by fasteners 7 to the rear end portion of the sleeve 3 to hold the rear friction bearing 5 against axial movement away from the distancing element 6.

The rear end wall 1*a* of the hopper 1 has laterally extending projections or lugs 10 which are threadedly or otherwise connected with pairs of parallel tie rods 11. The rear ends of the tie rods 11 are threadedly or otherwise fixedly connected to a platen 12 which is remote from the hopper 1 and supports a double-acting hydraulic cylinder 13 forming part of a motor which serves to reciprocate the piston 42 with respect to the hopper 1. The cylinder 13 contains a piston 13*a* (FIG. 4) which is connected with the rear end portion of a piston rod 14. The latter extends forwardly through a central opening in the platen 12 and is articulately coupled to the rear end portion of the shank 39 by a pin 41 extending at right angles to the axis of the piston 42. The pin 41 extends through the flanges of a bifurcated coupling member 40 which is rigidly connected to or made integral with the rear end portion of the shank 39. The piston rod 14 has a forwardly extending flattened extension 14*a* which is disposed between the flanges of the coupling member 40 and is also traversed by the pin 41.

The piston 42 has a preferably flat and smooth front end face 42*a* which is surrounded by an annular cutting edge 55. The means for separably securing the piston 42 to the front end portion of the shank 39 comprises a screw or bolt 43 having a head whose front end face is flush with the end face 42*a* and which extends through a central passage of the piston 42 and is threadedly connected with a nut 44 which is received in the deepmost portion of a counterbore in the front end of the shank 39. This counterbore further receives a smaller-diameter hub of the piston 42. The nut 44 is preferably welded to the shank 39. The piston 42 will be replaced with a new one or repaired when its cutting edge 55 wears away sufficiently to reduce the likelihood of proper cooperation with a complementary cutting edge 19. The piston 42 (or at least the front portion thereof) preferably consists of hard steel or another hard and wear-resistant metal.

The front wall 1*b* of the hopper 1 is formed with a circular opening 15 which is concentric with the opening 2 and receives the rear end portion of a cylindrical sleeve 16. The latter has a flange 16*a* which is separably but rigidly secured to the end wall 1*b* by bolts, nuts or analogous fasteners 17. The sleeve 16 surrounds a cylindrical insert or barrel 18 which preferably consists of hard steel or another hard and wear-resistant metal and whose rear end portion is formed with the aforementioned complementary annular cutting edge 19 for the cutting edge 55 of the piston 42. The barrel 18 is preferably a press-fit in the sleeve 16. The front end portion of the sleeve 16 carries a valve 21 which is secured thereto by bolts, screws or analogous fasteners 20, and a tubular outlet or discharge member 22 for slugs of compacted material. The flange at the rear end of the outlet 22 is preferably secured to the front housing section or portion 26 of the valve 21 by screws 22*a* or the like.

Figure 3A:
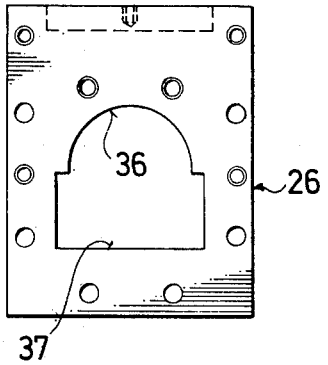
FIG. 3*a* is a front elevational view of the front section of the housing for the valve in the press of FIGS. 1–2.
Figure 3B:
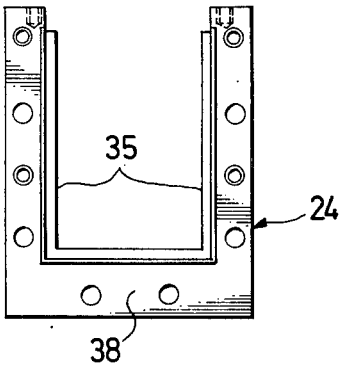
FIG. 3*b* is a front elevational view of the intermediate section of the valve housing.
Figure 3C:
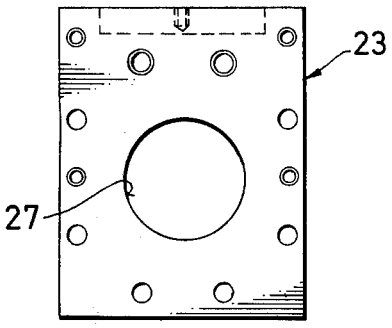
FIG. 3*c* is a front elevational view of the rear section of the valve housing.
Figure 3D:
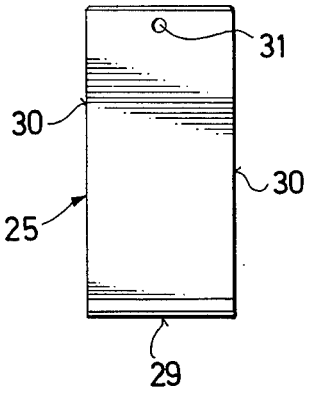
FIG. 3*d* is a front elevational view of the valve member.

The valve 21 resembles a gate valve and includes a housing having a rear section or portion 23 (see also FIG. 3*c*), the front portion or section 26 (see also FIG. 3*a*) and an intermediate section or portion 24 (see also FIG. 3*b*). The valve 21 further comprises a valve member or gate 25 (see also FIG. 3*d*). The U-shaped intermediate housing section 24 is clamped between the sections 23, 26 by the screws 20 and has vertically extending parallel guides or ways 35 for the respective vertical marginal portions 30 of the gate 25. The section 23 has a circular opening 27 which registers with the axial bore of the cylindrical barrel 18 in the interior of the front sleeve 16. That end portion of the surface surrounding the bore 27 which is remote from the barrel 18 constitutes a circular cutting edge 28 which cooperates with a horizontal cutting edge 29 at the lower end of the gate 25. The housing section 23 preferably consists of hard steel or another hard and wear-resistant metal, the same as the gate 25. This gate is actually a flat knife which cooperates with a counterknife (housing section 23 of the valve 21) to cut across the slug of compacted material when the gate is caused to descend in the intermediate section 24. The upper portion of the gate 25 has a hole 31 for a pin 32 which connects it to a piston rod 33 forming part of a motor which serves to move the gate 25 up and down, i.e., in a plane preferably extending at right angles to the axis of the piston 42. The motor which moves the gate 25 has a double-acting hydraulic cylinder 34 for a piston 34*a* (FIG. 4) which is connected with the upper end portion of the piston rod 33.

The ways 35 in the intermediate housing section 24 of the valve 21 are preferably dimensioned and machined in such a way that the respective marginal portions 30 of the gate 25 are movable therein without any or with minimal clearance.

The front section 36 of the housing of the valve 21 has an opening including a substantially semicircular upper portion 36 which is aligned with the upper portion of the opening 27 and a substantially rectangular enlarged lower portion 37 which registers with but extends laterally beyond the lower portion of the opening 27. The enlarged portion 37 serves to insure that material which is being severed by the cutting edge 29 in cooperation with the cutting edge 28 cannot or does not accumulate in the lower portions of the ways 35, i.e., that such material cannot interfere with movements of the gate 25 all the way to its lower end position in which the valve 21 completely seals the outlet 22 from the cylindrical barrel 18. As shown in FIG. 3*a*, the width of the portion 37 of the opening in the section 26 preferably equals or slightly exceeds the distance between the deepmost portions of the ways 35 in the intermediate section 24. The web of the intermediate section 24 is shown at 38 (see FIG. 3*b*); the upper edge portion of this web is preferably flush with the surface bounding the lowermost part of the portion 37 of composite opening in the section 26.

When the motor including the piston rod 33 causes the gate 25 to move to its lower end position, the rear surface of the gate sealingly engages the front side of the section 23 so that the opening 27 is completely or nearly completely sealed from the opening 36, 37 in the section 26. The cutting edge 29 of the gate 25 is then located at a level at least slightly below the lowermost part of the opening 27.

Figures 4, 6:
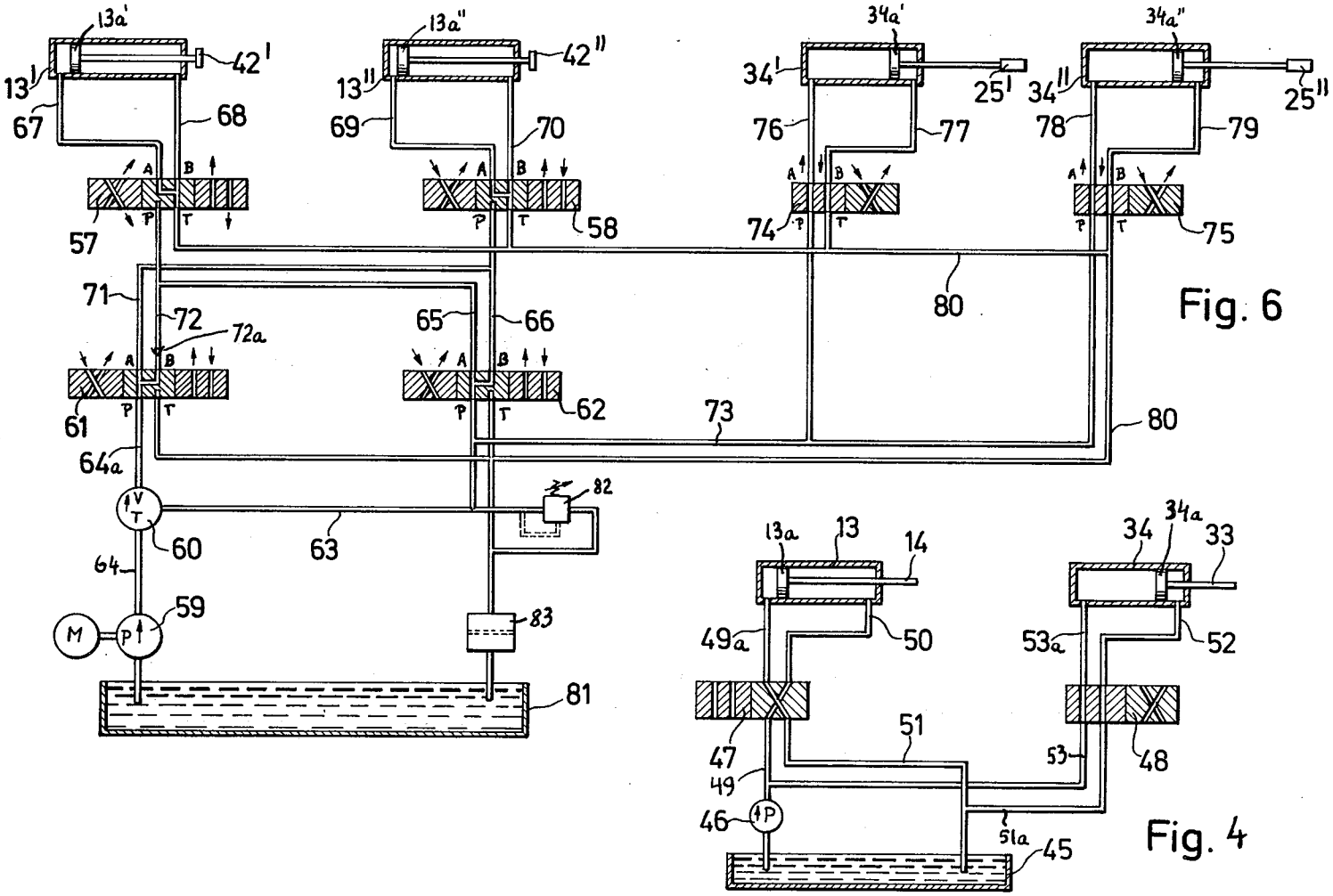
FIG. 4 is a diagrammatic view of the motors for the piston and valve member in the press of FIGS. 1–2 and of the control means which operates the motors.
FIG. 6 is a diagrammatic view of the motors for the pistons and valve members in the press of FIG. 5 and of the control means which operates the motors.

The motor including the double-acting cylinder 14 serves to reciprocate the piston 42 between a front end position or extended position V and a rear end position or retracted position H, both shown in FIG. 1. The hydraulic circuit which causes pressurized fluid to flow into and from the chambers of the cylinders 13 and 34 is shown in FIG. 4. This circuit comprises a tank 45 or another suitable source of fluid (preferably oil), a pump 46 which constitutes a source of pressurized fluid and is driven by a motor (not shown) to draw fluid from the tank 45, a pressure conduit or line having branches 49, 53 receiving pressurized fluid from the outlet of the pump 46, a two-way control valve 47 in the branch 49, a two-way control valve 48 in the branch 53, return conduits 51, 51*a* which respectively connect the outlet ports of valves 47, 48 with the tank 45, a conduit 49*a* which connects the valve 47 with the rear chamber of the cylinder 14, a conduit 50 which connects the valve 47 with the front chamber of the cylinder 14, and conduits 52, 53*a* which respectively connect the valve 48 with the lower and upper chambers of the cylinder 34. The solenoids, springs and/or analogous means which can actuate the control valves 47, 48 in a desired sequence are not shown in FIG. 4.

When the piston 42 is to be moved from the retracted position H to the extended position V, the valve 47 admits pressurized fluid to the rear chamber of the cylinder 14 via conduit 49*a* and allows fluid to flow from the front chamber of the cylinder 14 into the tank 45 via conduits 50, 51. When the piston 42 is to be returned from the extended position V to the retracted position H, the valve 47 is adjusted to connect the outlet of the pump 46 with the conduit 50 and to connect the conduit 49*a* with the conduit 51. The motor including the cylinder 34 moves the gate 25 to the lower end position shown in FIG. 2 when the piston 42 completes its forward stroke. Thus, as the piston 42 begins to move rearwardly, the pressure in the cylindrical barrel 18 drops below atmospheric pressure and fresh material is caused to penetrate into the barrel as soon as the piston 42 is retracted into the interior of the hopper 1 and continues to move toward the retracted position H. This contributes to automatic filling of the barrel 18 with material so that such filling can be effected without resorting to any tamping or other auxiliary instrumentalities. The downward movement of gate 25 takes place in response to such adjustment of the valve 48 that the outlet of the pump 46 communicates with the conduit 53*a* while the valve 48 connects the conduit 52 with the return conduit 51*a*.

The gate 25 can be lifted not later than at the time the piston 42 begins its forward stroke and is invariably lifted not later than when the piston 42 begins to penetrate into and moves in the barrel 18. The valve 48 then connects the outlet of the pump 46 with the conduit 52 and allows the conduit 53*a* to communicate with the conduit 51*a*.

When the piston 42 moves forwardly, metallic or other solid ingredients which are not in full register with the opening 27 are severed by the cutting edge 55 of the piston 42 in cooperation with the cutting edge 19 of the cylindrical barrel 18. The valves 47 and 48 are preferably reset when the piston 42 reaches its extended position V, i.e., the piston 42 is then retracted and the gate 25 is caused to move downwardly. The arrangement may be such that the rearward movement of the piston 42 begins with a slight delay following the downward movement of gate 25. This insures that the cutting edge 29 of the gate 25 can clean the front end face 42*a* of the piston 42. As mentioned above, suction in the barrel 18 (during movement of the piston 42 toward the retracted position H) causes at least some material which is confined in the hopper 1 to penetrate into the barrel 18. The valves 47, 48 are reset again when the piston 42 reaches its retracted position H so that the piston 42 begins to move forwardly and the gate 25 is retracted to its upper end position not later than when the barrel 18 contains a rod-like slug of compacted material.

The barrel 18 in the front sleeve 16 is preferably provided with a semicylindrical trough- or shell-shaped extension 180 which is indicated by phantom lines because it constitutes a preferred but optional feature of the pump. The upper side of the extension 180 is bounded by a semicylindrical concave surface 181 whose center of curvature is located on the axis of the piston 42. The extension 180 projects well into the interior of the hopper 1; in fact, this extension can terminate close or immediately adjacent to the rear end wall 1*a*. Thus, the lower portion of the peripheral surface of the piston 42 can slide along the concave surface 181 while the piston 42 is located in the hopper 1 and the piston thereupon slides along the cylindrical internal surface of the barrel 18 while it continues to advance toward the extended position V. The extension 180 not only centers the piston 42 during movement in the hopper 1 (to thus insure that the piston 42 invariably finds its way into the barrel 18) but also intercepts a substantial amount of material which is pushed into the barrel while the piston performs a forward stroke. It has been found that the provision of extension 180 results in substantial reduction of wear upon the cutting edges 55 and 19. As a rule, the extension 180 will be integral with the barrel 18; however, it is equally possible to machine the extension as a separate part which is bolted or otherwise removably secured to the barrel 18 and/or front sleeve 16 and/or front end wall 1*b*.

Figure 5:
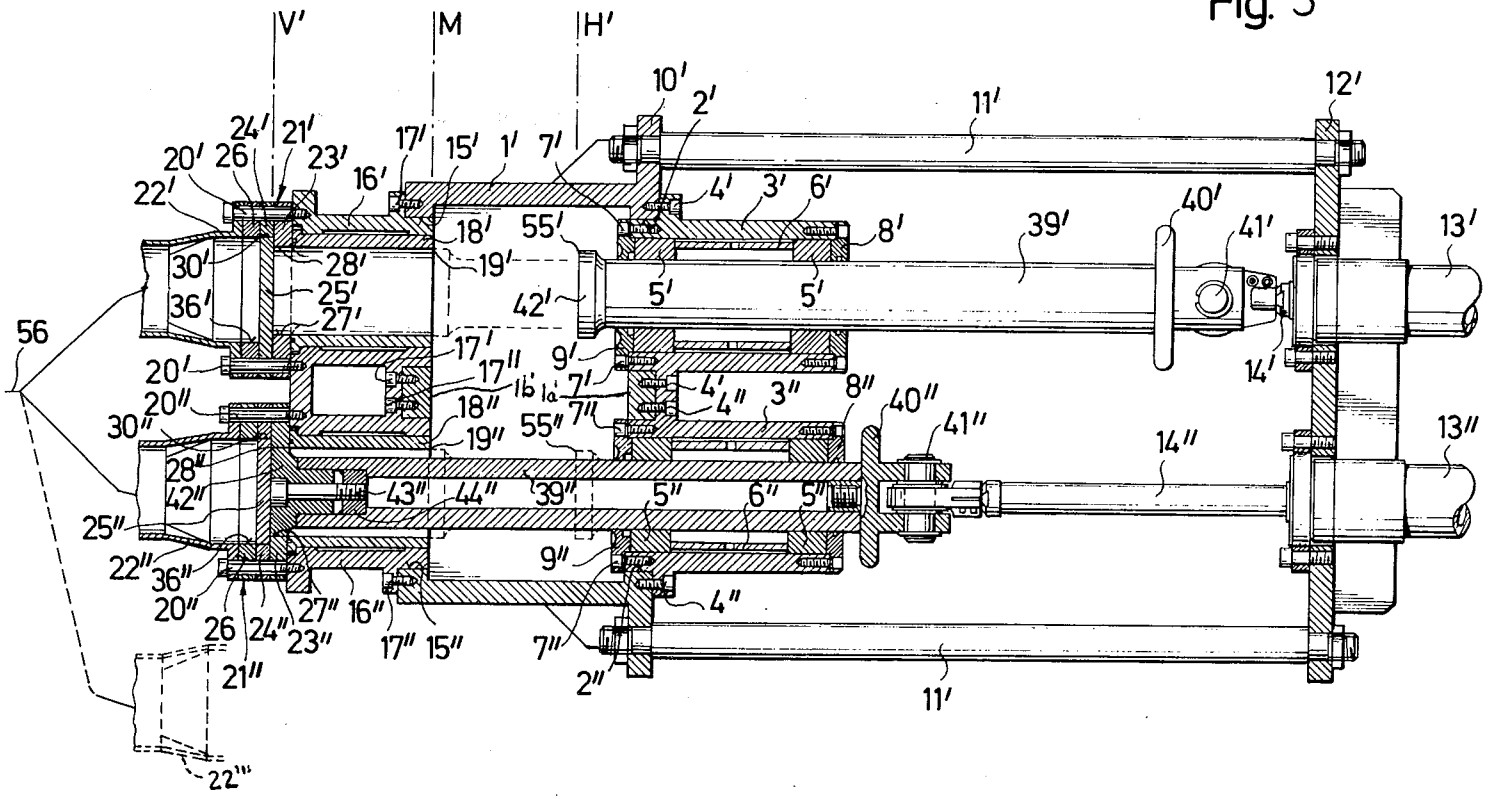
FIG. 5 is a central longitudinal horizontal sectional view of a second sludge press with two parallel pistons.

FIG. 5 shows a heavy-sludge press with two pistons 42′, 42″. All such parts of this duplex pump which are identical with or clearly analogous to the corresponding parts of the sludge press shown in FIGS. 1–3*d* are denoted by similar reference characters followed by one (pistion 42′) or two (piston 42″) primes. The hopper 1′ has a rear end wall 1*a*′ with two circular openings 2′, 2″ and a front end wall 1*b*′ with two circular openings 15′, 15″. The platen 12′ is large and strong enough to support the double-acting hydraulic cylinders 13′ and 13″; this platen is connected with the lugs 10′ of the rear end wall 1*a*′ by tie rods 11′. The strokes which the pistons 42′, 42″ performs during movement between the extended and retracted positions V′ and H′ are preferably identical. The line M denotes in FIG. 5 the median or central positions of the pistons 42′ and 42″; the front end faces of the pistons 42′, 42″ are then respectively coplanar with the cutting edges 19′, 19″.

The duplex press of FIG. 5 preferably operates in such a way that the piston 42′ assumes the extended position V′ when the piston 42″ is somewhere between the positions V′, H′ or in the position H′, and vice versa. Consequently, the gates 25′, 25″ of the valves 21′, 21″ are also actuated in such a way that the gate 25′ assumes its lower end position (barrel 18′ sealed from the outlet 22′) while the gate 25″ is at least partially lifted, or vice versa. The outlets 22′, 22″ can discharge slugs of compacted material into a common discharge tube 56 whose front end portion may constititute the burner nozzle of a furnace or combustion chamber (not shown) wherein the combustible ingredients of the slugs are combusted and certain other ingredients evaporated.

In accordance with a presently preferred embodiment, the duplex press of FIG. 5 is operated as follows:

When the piston 42″ reaches the median position M on its way toward the extended position V′, the valve 22″ is open, i.e., the gate 25″ is held in the upper end position. The piston 42″ forms a slug which fills the barrel 18″ and is pushed through the open valve 21″ and outlet 22″ into the discharge tube 56. As the piston 42″ moves from the position M toward the extended position V′, the piston 42′ moves from the extended position V′ toward the retracted position H′ and thereupon back toward the median position M in which it comes to a halt, i.e., it remains idle until the piston 42″ reaches the extended position V′. The valve 21′ remains closed while the piston 42′ moves from the extended position V′ to the retracted position H′ and thereupon to the median position M.

When the piston 42″ reaches the extended position V′, the gate 25″ is moved to its lower end position to close the valve 21″ whereupon the piston 42″ begins to move toward the retracted position H′ and preferably immediately back toward the median position M. The piston 42′ begins to move from the position M toward the extended position V′ as soon as the piston 42″ begins its rearward stroke, and the gate 25′ is lifted to open the valve 21′. Thus, the piston 42′ can push a slug of material through and beyond the barrel 18′ so that such slug passes through the outlet 22′ and into the tube 56. The piston 42″ assumes the median position M not later than when the piston 42′ reaches the extended position V′. The gate 25′ thereupon descends to close the valve 21′ before the piston 42′ begins to move rearwardly, and the piston 42″ advances from the position M toward the extended position V′ while the gate 25″ moves to its upper end position to open the valve 21″. The piston 42′ moves rearwardly all the way to the retracted position H′ and thereupon back to the median position M where it comes to a halt until the piston 42″ reaches the extended position V′. Such alternating forward movements of the pistons 42′ and 42″ insure that the tube 56 receives a practically continuous slug of compacted material which comprises increments or lengths supplied alternately by the outlets 22′ and 22″.

The hydraulic control circuit which can move the pistons 42′, 42″ and gates 25′, 25″ in the just described manner is shown in FIG. 6. This circuit comprises a tank 81 for a supply of oil or another suitable hydraulic fluid, a variable-delivery pump 59 which constitutes a source of pressurized fluid and draws fluid from the tank 81, and adjustable flow restrictor 60 which is installed in a pressure line or conduit 64 connected to the outlet opening of the pump 59, two pressure conduits 63, 64*a* which receive fluid from the flow restrictor 60, and two multi-way valves 61, 62 which have inlet ports P respectively connected with the conduits 64*a*, 63. The valve 61 has additional ports A, B which are respectively connected with conduits 71, 72 the latter of which is connected to the port P of a two-way valve 57. The ports A and B of the valve 57 are respectively connected to the rear and front chambers of the cylinder 13′ by conduits 67 and 68 so that the piston 42′ performs a forward stroke when the conduit 67 receives pressurized fluid from the conduit 64*a* via valve 61 and that the piston 42′ performs a rearward stroke when the conduit 64*a* communicates with the conduit 68 via valves 61 and 57.

The rear and front chambers of the cylinder 13″ respectively communicate with conduits 69, 70 which are connected to the ports A and B of a valve 58 similar to or identical with the valve 57. The port P of the valve 58 is connected by conduit 66 with the port B of the valve 62, and the port A of the valve 62 is connected with the conduit 72 by a conduit 65. The conduit 71 connects the port A of the valve 61 with the conduit 66. The piston 42″ is retracted when the conduit 70 communicates with the conduit 63 via valves 62, 58, and the piston 42″ moves forwardly when the conduit 69 communicates with the conduit 64*a* through the medium of valves 58 and 61. The rate of fluid flow in the conduit 64*a* is preferably at least slightly (and most preferably substantially) less than in the conduit 63. The flow restrictor 60 acts not unlike a distributor valve as well as a means for proportioning the rates of fluid flow in the conduits 63 and 64*a*. The conduit 65 can supply fluid to the conduit 72 because it receives fluid from the conduit 63; the conduit 72 contains a check valve 72*a* serving to prevent the flow of fluid which is supplied by conduit 65 into the port B of the valve 61.

The fluid which is supplied by the conduit 64*a* can flow through the valve 61 to be admitted into the conduit 71 or 72, i.e., into the valve 58 or 57.

The conduit 63 further supplies pressurized fluid to a conduit 73 which has two branches connected to the ports P of two-way valves 74, 75 for the double-acting cylinders 34′, 34″. The ports A and B of the valve 74 are respectively connected with the upper and lower chambers of the cylinder 34′ by conduits 76, 77. The conduits 78 and 79 respectively connect the ports A, B of the valve 75 with the upper and lower chambers of the cylinder 34″. A return conduit 80 is connected with the low-pressure ports T of the valves 57, 58, 61, 62, 74, 75 and serves to discharge spent fluid into the tank 81. The conduit 63 contains a pressure relief valve 82 which, when open, discharges fluid into the return conduit 80. The latter contains an oil filter 83.

When the piston 42″ is to move from the median position M toward the extended position V′ of FIG. 5, the rear chamber of the cylinder 13″ receives pressurized fluid by way of the conduit 69, valve 58, conduit 71, valve 61 and conduit 64*a*. The conduit 70 then connects the front chamber of the cylinder 13″ with the return conduit 80 via valve 58. At the same time, the conduit 79 admits pressurized fluid to the lower chamber of the cylinder 34″ so that the gate 25″ moves upwardly to open the valve 21″. The conduit 79 receives pressurized fluid from the conduit 73 by way of the valve 75. The valve 75 then connects the conduit 78 with the return conduit 80.

The forward movement of piston 42″ from the median position M toward the extended position V′ takes place simultaneously with a much more rapid movement of the piston 42′ from the extended position V′ to the retracted position H' and thereupon to the median position M. To this end, the conduit 68 admits pressurized fluid into the front chamber of the cylinder 13' (i.e., in front of the piston 13a'). The valve 57 connects the conduit 68 with the conduit 65 which receives fluid at a relatively high rate from conduit 63 via valve 62. When the piston 42' reaches the retracted position H', the position of the valve member in the valve 57 is changed so that the conduit 67 communicates with the conduit 65 which continues to receive a relatively large quantity of fluid from the conduit 63 via valve 62. The conduit 68 is then connected with the return conduit 80 via valve 57 so that the piston 42' can rapidly advance from the retracted position H' toward the median position M. The position of the valve member in the valve 57 remains unchanged until the piston 42' reaches the median position M. During movement of the piston 42' from the retracted position H' to the median position M, the conduit 76 communicates with the outlet of the pump 59 (and more particularly with the conduit 63) via conduit 73 and valve 74 so that the gate 25' remains in its lower end position and the valve 21' remains closed.

When the piston 42' reaches the median position M (coming from the retracted position H'), the valve 57 is reset so that it seals its port P and/or T from the conduits 67, 68 whereby the piston 42' remains in the median position M until the piston 42" reaches the extended position V'. The valve 57 is then actuated again to connect the conduit 67 with the conduit 72 and the valve 61 is reset to connect the conduit 72 with the conduit 64a' so that the flow of fluid into the rear chamber of the cylinder 13' takes place at a relatively slow rate (while the piston 42' moves from the position M toward the position V'). The valve 74 is reset at the same time to connect the conduit 77 with the conduit 73 whereby the gate 25' moves upwardly to open the valve 21' while the conduit 76 communicates with the return conduit 80.

The valve 75 is reset whenever the piston 42" reaches its extended position V' and thereby connects the conduit 78 with the conduit 73 while the conduit 79 communicates with the return conduit 80. This causes the gate 25" to move toward its lower end position in order to close the valve 21". When the gate 25" reaches its lower end position, the valves 58 and 62 are actuated so that the conduit 70 communicates with the conduit 66 and the conduit 69 communicates with the return conduit 80. The valve 62 connects the conduit 66 with the conduit 63 so that the piston 42" rapidly moves from the extended position V' toward the retracted position H'. Once the piston 42" reaches the position H', the valve 58 is reset to connect the conduit 69 with the conduit 66 and to simultaneously connect the conduit 70 with the return conduit 80. This causes the piston 42" to move from the position H' toward the position M in which it comes to a halt because the valve 58 is actuated to seal its ports A, B from the respective ports P and T. The valve 58 is reset again to allow the piston 42" to move from the position M toward the position V' at a relatively low speed when the piston 42' reaches its extended position V'. The same procedure is thereupon repeated again and again, as long as the pump 50 continues to supply pressurized fluid to the flow restrictor 60 and as long as the programming system for the valves 57, 58, 61, 62, 74, 75 continues to actuate these valves in the aforedescribed sequence. Of course, it is equally possible to actuate the valves 57, 58, 61, 62, 74 and/or 75 by hand; however, it is normally preferred to employ mechanical, electronic, pneumatic, pneumonic or other suitable programming means of any known design.

The improved sludge press is susceptible of many additional modifications without departing from the spirit of the invention. For example, the sludge press may comprise more than two pistons. FIG. 5 shows by broken lines a third outlet 22''' which can receive slugs from a third piston (not shown) and can discharge such slugs into the tube 56 alternatingly with the outlets 22', 22". The circuit of FIG. 6 is then modified so that it can insure the movements of three pistons in a preselected sequence.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims:

1. A press, particularly a sludge press, comprising a receptacle for the material to be presses; an elongated hollow barrel having an open rear end in communication with the interior of said receptacle and an open front end; a piston reciprocable in line with said barrel between a retracted position in which the material in said receptacle can enter the rear end of said barrel and an extended position in which said piston is located in and at least close to said front end of said barrel, said piston having a front face and a first annular cutting edge surrounding said front face and said barrel having at said rear end thereof a complementary second annular cutting edge through which said piston passes during movement toward said extending position; and a valve provided at said front end of said barrel, said valve having a valve member movable between a first position in which said front end of said barrel is at least substantially sealed, particularly during movement of said piston from said extended position, and a second position in which said front end is exposed so that said piston can expel material from said barrel forwardly during movement to said extended position thereof.

2. A press as defined in claim 1, wherein said piston is located in the interior of said receptacle in said retracted position thereof.

3. A press as defined in claim 1, further comprising first motor means operable to move said piston between said extended and retracted positions, second motor means operable to move said valve member between said first and second positions, and control means for operating said motor means.

4. A press as defined in claim 3, wherein each of said motor means comprises a fluid-operated double-acting cylinder and piston unit and said control means comprises control valve means for regulating the flow of fluid to and from said units.

5. A press as defined in claim 4, wherein said control means further comprises a source of pressurized fluid and conduit means connecting said source with said control valve means and said control valve means with said units.

6. A press as defined in claim 1, further comprising a second barrel parallel with said first mentioned barrel and having an open rear end communicating with the interior of said receptacle and provided with a third annular cutting edge and an open front end, a second piston reciprocable in line with said second barrel between a retracted position in which the material in said receptacle can enter the rear end of said second barrel and an extended position in which said second piston is located in and at least close to the front end of said second barrel, said second piston having a front face and an annular fourth cutting edge complementary to said third cutting edge, and a second valve provided at said front end of said second barrel, said second valve having a second valve member movable between a first position in which said front end of said second barrel is at least substantially sealed, particularly during movement of said second piston from said extended position, and a second position in which said front end of said second barrel is exposed so that said second piston can expel material from said second barrel forwardly during movement to said extended position.

7. A press as defined in claim 6, further comprising first motor means operable to move said first mentioned piston between said extended and retracted positions, second motor means operable to move said first mentioned valve member between said first and second positions, third motor means operable to move said second piston, fourth motor means operable to move said second valve member, and control means for operating said motor means.

8. A press as defined in claim 7, further comprising a common discharge tube communicating with said front ends of said barrels in the second positions of the respective valve members.

9. A press as defined in claim 8, further comprising first and second tubular outlets respectively communicating with the front ends of said first mentioned and second barrels in the second positions of the respective valve members, said outlets further communicating with said tube.

10. A press as defined in claim 7, wherein each of said pistons is movable to a median position intermediate said extended and retracted positions thereof, said first and fourth cutting edges being respectively adjacent to said second and third cutting edges in said median positions of said pistons.

11. A press as defined in claim 10, wherein said control means comprises devices for maintaining said first mentioned piston in said median position while said second piston assumes said extended position and vice versa.

12. A press as defined in claim 10, wherein each of said motor means comprises a fluid-operated doubleacting cylinder and piston unit and said control means comprises a source of pressurized fluid, at least one control valve for each of said units, and conduit means connecting said control valves with said source and with the respective units.

13. A press as defined in claim 12, wherein said conduit means comprises a first conduit which can supply to said control valves for said first and third units pressurized fluid at a relatively high rate during movement of the respective pistons from the extended to the retracted and thereupon from the retracted to the median positions thereof and a second conduit which can supply to said valves for said first and third units fluid at a relatively low rate during movement of the respective pistons from said median to said extended positions thereof so that the interval of time required by a piston to move from said extended to said retracted and thereupon to said median position thereof does not exceed the interval of time required to move a piston from said median to said extended position.

14. A press as defined in claim 1, wherein said barrel and said piston consist of a hard metal, at least in the regions of the respective cutting edges.

15. A press as defined in claim 1, wherein said valve member is reciprocable between said first and second positions substantially at right angles to the axis of said piston and said valve further comprises a housing for said valve member, said housing having guides for said valve member and said valve member having a cutting edge which severs the material in front of said piston during movement of said valve member to said first position.

16. A press as defined in claim 15, wherein said housing comprises a rear section adjacent to said front end of said barrel and a front section spaced apart from said rear section, said guides being disposed between said front and rear sections and said sections having openings through which the material passes from said barrel during movement of said piston to said extended position in the second position of said valve member.

17. A press as defined in claim 16, wherein said rear section of said housing has an annular cutting edge which surrounds the opening in said rear section and said cutting edge of said valve member moves along said cutting edge of said rear section during movement of said valve member between said first and second positions thereof.

18. A press as defined in claim 16, wherein the cross-sectional area of the opening in said front section of said housing is greater than the cross-sectional area of the opening in said rear section so as to allow for expulsion of material from said guides during movement of said valve member from said second to said first position thereof.

19. A press as defined in claim 18, wherein said opening of said rear section is a circular opening and said opening of said front section includes a substantially semicircular portion in register with substantially one-half of the opening in said rear section and a polygonal portion registering with but having an area greater than the area of the other half of the opening in said rear section.

20. A press as defined in claim 16, wherein said valve member and said rear section of said housing consist, at least in part, of a hard metallic material.

21. A press as defined in claim 1, wherein said valve is a gate valve.

22. A press as defined in claim 1, further comprising a fluid-operated double-acting cylinder and piston unit for moving said valve member between said first and second positions and control means for operating said unit, said control means comprising a source of pressurized fluid, a multi-way control valve, and conduit means connecting said control valve with said source and said unit.

23. A press as defined in claim 1, wherein said piston is reciprocable along a substantially horizontal path and said reservoir comprises a hopper having an open top.

24. A press as defined in claim 23, wherein said barrel comprises a trough-shaped extension in said hopper and below said path, said extension having a concave internal surface along which said piston slides during a portion of said movement between said extended and retracted positions.

25. A press as defined in claim 24, wherein the length of said extension is such that said piston remains in contact with said concave surface in said retracted position thereof.

26. A press as defined in claim 1, further comprising first and second motor means for respectively moving said piston and said valve member and control means for operating said motor means so as to maintain said piston in said extended position while said valve member moves to said first position thereof and for maintaining said valve member in said first position during movement of said piston from said extended position.

* * * * *